United States Patent [19]

Billard et al.

[11] Patent Number: 4,693,429

[45] Date of Patent: Sep. 15, 1987

[54] DEVICE AND PROCESS FOR SIMULTANEOUSLY WINDING SEVERAL SEPARATE FIBERS ON A ROTATING SUPPORT

[75] Inventors: Georges Billard, Chamberly-Le-Vieux; Francoise Blanchard, Chambery; Willy Klemenz, Cognin; Roger Combet, La Motte Servolex; Daniel Richard, Montmelian, all of France

[73] Assignee: Vetrotex Saint Gobain, Chambery, France

[21] Appl. No.: 798,071

[22] Filed: Nov. 14, 1985

[30] Foreign Application Priority Data

Jul. 25, 1985 [FR] France ..... 85 11378

[51] Int. Cl.[4] ..... B65H 54/08; B65H 54/28

[52] U.S. Cl. ..... 242/18 G; 242/18 A; 242/42; 242/43 R; 242/157 R

[58] Field of Search ..... 242/18 G, 18 A, 18 R, 242/42, 43 R, 157 R

[56] References Cited

U.S. PATENT DOCUMENTS

| | | | |
|---|---|---|---|
| 3,109,602 | 11/1963 | Smith | 242/18 G |
| 3,371,877 | 3/1968 | Klink et al. | 242/18 G |
| 3,414,956 | 12/1968 | Genson | 242/18 G X |
| 3,547,361 | 12/1970 | Klink | 242/18 G |
| 3,653,860 | 4/1972 | Smith et al. | 242/18 G X |
| 3,777,470 | 12/1973 | Suzuki et al. | 242/42 X |
| 3,901,455 | 8/1975 | Carlisle | 242/18 G |
| 4,130,248 | 12/1978 | Hendrix et al. | 242/18 G |
| 4,167,252 | 9/1979 | Klink et al. | 242/18 G |
| 4,235,387 | 11/1980 | Nicoulaud et al. | 242/18 G |
| 4,322,041 | 3/1982 | Schuller et al. | 242/42 |
| 4,389,024 | 6/1983 | Sanders | 242/18 G |
| 4,421,282 | 12/1983 | McKinney, III | 242/18 G |
| 4,488,686 | 12/1984 | Reese | 242/18 G |
| 4,509,702 | 4/1985 | Reese | 242/42 X |
| 4,538,773 | 9/1985 | McEathron | 242/18 G |

FOREIGN PATENT DOCUMENTS

| | | |
|---|---|---|
| 0000853 | 8/1978 | European Pat. Off. . |
| 2182381 | 4/1972 | France . |
| 2425399 | 5/1978 | France . |

*Primary Examiner*—Stanley N. Gilreath
*Attorney, Agent, or Firm*—Pennie & Edmonds

[57] ABSTRACT

The invention relates to a winding device and process to produce packages from several separate continuous fibers. The installation of this invention includes a spinneret receiving a thermoplastic material in the molten state, a rotating spindle carrying a support and drawing strands of material from the orifices of the spinneret and winding of the resulting fibers, a gathering and guiding device and a crisscrossing device including a fiber guide with an opening opposite the spindle communicating with an interior guide zone provided with at least two notches on its periphery.

11 Claims, 5 Drawing Figures

20
21
22
19 x
36
35
34
33
32
y
31
15b
15a 10
11
12
13
14
14
15
15
16
18
19
24
25
26
27
23
41
B1
28
B2
37
29
17
30
38

DEVICE AND PROCESS FOR SIMULTANEOUSLY WINDING SEVERAL SEPARATE FIBERS ON A ROTATING SUPPORT

TECHNICAL FIELD

The invention relates to a winding device and process for making packages from several continuous strands of fibers.

More particularly, the invention relates to a winding device and process which produce packages formed with straight sides or edges from several separate strands or fibers.

BACKGROUND INFORMATION

In numerous applications, continuous strands or fibers are removed from packages or reels formed on cylindrical supports. The strands or fibers are removed by unwinding them from the outside or inside of the package.

It is very important that the fibers or strands be removed as uniformly as possible. An erratic movement of the fibers can damage them or cause adjacent turns to become tangled. Fiber tangles can result in loops or other discontinuities in the packages and cause processing defects. The removal operation is very delicate because several separate fibers or strands are simultaneously wound on the same support.

The uniform removal of strands or fibers is primarily governed by the manner in which the package of fibers was made. A fiber package is formed by winding at least one strand on a rotating support and simultaneously moving that strand back-and-forth, parallel to the axis of rotation of the support. The proper movement of the fiber is maintained by various guide elements which give the resulting package with its shape.

Some packages have a relatively thick central part tapering down toward the ends of the package to zones of uniformly decreasing thickness. It is not possible to remove separate fibers wound simultaneously on such a package in a uniform manner. When the fiber turns laid down in zones with different diameters unwind, the differences in their lengths cause the formation of loops and, therefore, tangles.

Other packages made using a moving fiber guide have the approximate shape of a cylinder with more or less uniform edges. In such prior art devices, when the guide carrying the fiber or strand back-and-forth reached the end of its travel, there was a very brief period of hesitation before the guide started to move in the opposite direction.

During this period, the turns were superposed on one another and could fall on both sides of a plane perpendicular to the axis of rotation of the support at the end of the travel of the fiber guide. When several separate fibers are wound simultaneously, they can adhere to one another during this brief period of hesitation. During unwinding, such an adhesion modifies the appearance of the fiber, impairing the quality of the products made from it.

On the other hand, if some turns are laid down outside the plane of travel of the guide, they can easily fall out of the edge of the package and be damaged during its storage and handling. During unwinding, such damaged fibers can cause the formation of loops or cause the fiber to break as it is removed.

In applications using packages consisting of several separate glass fibers, as, for example, in the production of cut fibers intended to reinforce materials having a base of polymers or elastomers, or in the production of mat from cut fibers, the quality of the final product is governed in large part by the rate of fiber separation, that is, the ratio between the number of simple fibers obtained on removal and the number of simple fibers initially wound.

The separation rate can vary as a result of partial adhesion of the fibers to one another during the winding process. Fiber adhesion becomes more pronounced in large packages and has led to limitations in package size and weight.

These deficiencies have prompted various proposed remedies to the limitations in prior art manufacturing techniques for cylindrical fiber packages and/or to imperfect fiber separation during winding.

One proposed solution, disclosed in U.S. Pat. No. 4,488,686 to Walter J. Reese, involves modification of the shape of the fiber guide and use of stops positioned at the end of travel of the fiber guide.

According to this invention, the transversing fiber guide is cutout in the shape of a triangle or rhombus. The cutout may even be semicircular or semielliptical in shape. The fiber guide has a central opening through which the fibers or strands are introduced at the beginning of the winding operation.

The fiber drawing installation includes a spinneret filled with molten glass. A large number of glass strands are mechanically drawn from orifices in the spinneret into the shape of elementary filaments. These filaments are joined together into at least two separate bundles which are passed over an oiling device. The bundles are then passed through a gathering device, each bundle becoming a separate fiber. The various fibers thus made are passed into a device provided with notches or any other means to maintain the separation of the fibers during their travel.

The separate fibers are introduced into the head of the fiber guide. During the winding operation, the fibers alternately slide from one side to the other of the cutout in the head of the fiber guide.

Two cylindrical rod stops are positioned on the drive device for the fiber guide, crosswise to the back-and-forth movement of the guide and close to each end of its travel. These stops function to gather the fibers into a single fiber at the end of the package. These gathered fibers forms a sharp lateral package edge practically at right angles to the cylindrical package itself.

A second solution to the problems of package manufacture is proposed in U.S. Pat. No. 4,509,702 to Walter J. Reese. The fiber drawing unit is almost identical to that disclosed in the preceding patent. However, the head of the fiber guide has several slots extending from the periphery of the guide and terminating at an interior curved end which can retain a strand or fiber. The curved ends of the slots are aligned one behind the other in a linear configuration approximately perpendicular to the axis of the support of the package. Each fiber is introduced in a different slot and positively guided during the winding operation.

The stops are placed on the driving device which move the fiber guide when it reaches each end of its travel. This movement of the guide serves to increase the tension on the fibers. Thus, when the fiber guide is in contact with the stops, the fibers are wound on the same turn at the package end. This provides sharp lateral package edges practically at right angles.

In these two patents, there is no disclosure of automatically transferring the fiber winding process from one support to another empty rotating support when the package has reached the desired diameter.

SUMMARY OF THE INVENTION

It is an object of the present invention to wind simultaneously several separate continuous fibers so that proper separation of such fibers is maintained during the entire winding operation.

It is an object of the present invention to manufacture a cylindrical package formed from several separate fibers with lateral straight edges and in which the fibers making up the package remain separate from the beginning to the end of the package.

It is an object of the present invention to maintain the separation of the fibers by keeping them under proper tension.

It is an object of the present invention to provide a distribution element for positively guiding several separate continuous fibers and apparatus for the automatic transfer of fibers from one rotating support to another rotating support.

A winding device constructed in accordance with the present invention is intended for the production and simultaneous winding, on the same support, of several separate continuous fibers of thermoplastic material such as glass. The device include a spinneret for receiving the material from which the fiber is made and maintaining it in the molten stage and a rotating spindle carrying a support which mechanically draws strands of material from the spinnaret in the form of elementary filaments. The device also includes a gathering and guide device which groups the elementary filaments into at least two separate fibers and guides the fibers to the spindle through crisscrossing device adjacent to the spindle. The crisscrossing device has a fiber guide driven in a back-and-forth movement to distribute the fibers on the support. Two stops are mounted at the end of the travel of the fiber guide. The fiber guide has an opening opposite the spindle to an interior zone of the guide. This zone is provided on its periphery with at least two notches or slots.

The dimensions of the opening and the interior zone of the fiber guide can be very varied. However, the opening must have a sufficient width to permit passage of the fibers into the guide. The opening can be relatively narrow and provide access to a wider interior zone. Conversely, the opening may be wider than the interior zone itself as when the opening and interior zone of the fiber guide are formed in the shape of a V. Notches are then made on at least one of the edges of the sides of the V. The edges of the interior zone need not be straight as in the preceding example but can be curved.

The notches are preferably uniformly distributed on both sides of a vertical plane going through the center of the fiber guide and perpendicular to the axis of rotation of the spindle. The ends of the notches are preferably inclined in relation to the vertical plane. The ends of two opposing notches are inclined so that a straight line extension of their inclination would converge below the fiber guide. Each notch is inclined so that the direction of travel of the fiber is maintained in that notch at the same angle as its direction of travel immediately prior to entering the notch.

When at least two notches are located on the same side of the interior portion of the guide, the distance separating the end of each notch from the center line of the interior of the guide must be different for each notch. Each fiber being wound is positioned in a notch.

As it is desired that the width of each bundle formed by the wound fibers should be rather small, the notches should be located in different vertical planes parallel to the axis of rotation of the spindle.

These staggered notches are uniformly distributed in two groups on each side of the vertical plane passing through the center of the fiber guide and perpendicular to the axis of rotation of the spindle. Vertical planes passing through the ends of the last notches of each group preferably form an angle between 5° and 90°.

This angle is varied based on the thickness of each wound fiber, the desired spacing on the package and the type of the oil deposited on the fiber.

The fiber guide of this invention is attached to a crisscrossing device which moves the fiber guide back-and-forth parallel to the axis of rotation of the spindle. The fiber guide and connecting piece are preferably made as light as possible by the use of light-density material and/or by hollowing out said parts.

The fiber drawing installation of this invention includes a device which maintains the separation of the fibers and keeps them under tension during the entire winding operation. This device is preferably provided with notches or slots, such as a comb, and placed slightly above the crisscrossing device carrying the fiber guide and outside the zone between two planes passing through the ends of travel of the fiber guide and perpendicular to the back-and-forth movement of the fiber guide.

The comb is fastened by an arm to the end of a jack which can move the comb from a high position to a low position and vice-versa.

During the winding process of this invention, elementary filaments are drawn mechanically from strands of molten material flowing from the orifices of the spinneret. The filaments are separated into at least two bundles and passed over an oiling element. The filaments of each bundle are gathered into a single fiber on a gathering device. The gathered filaments are maintained as separate fibers by means of an upper comb and a lower comb. The lower comb keeps the fibers outside the zone between two planes passing through the ends of travel of the fiber guide and perpendicular to its back-and-forth movement. The fibers are wound on a support carried by a rotating spindle. They are distributed on the spindle by a fiber guide driven back-and-forth by a crisscrossing machine.

This process of this invention can be used with a winding machine with a single spindle or with a drum winding machine which has two spindles and which permits the automatic transfer of fibers from one spindle to the other.

BRIEF DESCRIPTION OF THE DRAWINGS

The advantages of the invention will be apparent from the following description of specific embodiments of the invention. These preferred embodiments are described with reference to the following figures.

DESCRIPTION OF THE PREFERRED EMBODIMENT

Figure 1:
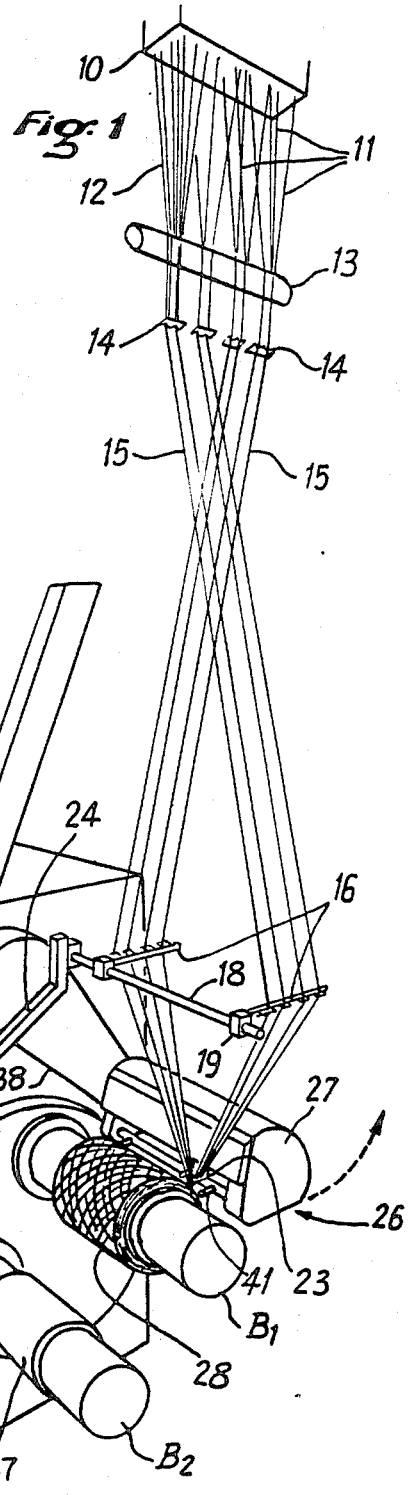
FIG. 1 is a view, in perspective, of a fiber drawing and winding installation used for making continuous glass fibers and equipped with the devices of this invention.

The installation shown in FIG. 1 includes a spinneret 10, which is shown diagrammatically at its base as a rectangular parallelepiped. The spinneret is fed molten glass from a source not shown in the figure.

The base of spinneret 10 is provided with a large number of orifices, through which the molten glass flows in the form of strands. These strands are thin and changed into elementary filaments 11 under the influence of the tension on them produced by the rotation of spindle $B_1$.

These filaments, joined in the form of several distinct bundles 12, pass over an oiling element at roller 13. These bundles eight in the example shown, are then brought into a gathering and guide device located below roller 13. The gathering device is made up of one or more plates 14 provided with notches. These guide elements, which can be of varied shapes, are generally referred to as combs. Fibers 15 take form after passing through the combs 14.

Figure 2:
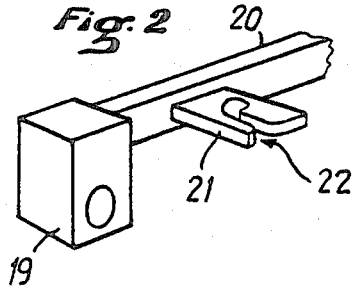
FIG. 2 is a partial view, in perspective, of portions of the installation shown in FIG. 1.

The guide device also includes one or more combs 16 positioned at a lower level near the winding machine 17. The two combs 16 are attached to a rod 18 by adjustable bracket 19. The structure of comb 16 is shown in FIG. 2. The comb 16 includes a bar 20 to which are fastened plates 21. The plate 21 is slotted with notch 22 which is curved at its inner end for insertion of fiber 15. Other methods of separating and guiding fibers well known in the art can also be used.

The combs 16 are located on either side of a zone defined by the two planes passing through the ends of travel of fiber guide 23 and perpendicular to the guide's back-and-forth movement. Rod 18, which is parallel to the axis of rotation of spindle $B_1$, is fastened to arm 24 and, thus, to a jack 25. Rod 18 can be fastened to one of the ends of arm 24. However, it is recommended that it be fastened to a middle point of the arm.

Jack 25 can be fastened to or independent of winding machine 17.

After passing through combs 16, fibers 15 converge toward fiber guide 23 which is connected, in a suitable way, to crisscrossing device 26 housed in body 27. The mechanism of crisscrossing device 26, an example of which is described in French Pat. No. 2,182,381, moves the fiber guide back-and-forth parallel to the axis of rotation of spindle $B_1$.

Crisscrossing device 26 has two stops 41, one located near each end of travel of fiber guide 23. The stops can be cylindrical rods placed approximately in a plane perpendicular to the axis of rotation of spindle $B_1$. They are described in detail in U.S. Pat. No. 3,371,877 to J. P. Klink et al.

Crisscrossing device 26 is fastened to the end of arm 38 which can rotate around a pin to move fiber guide 23 progressively further away from spindle $B_1$ as the package 28 enlarges. A device to effect such movement is described in European Pat. No. 853.

Mounted on winding machine 17 is a drum 29 with two spindles $B_1$ and $B_2$ which can alternately be placed in front of crisscrossing device 26.

The driving elements necessary for the operation of the spindles and crisscrossing device are enclosed in cover 30.

Figure 3:
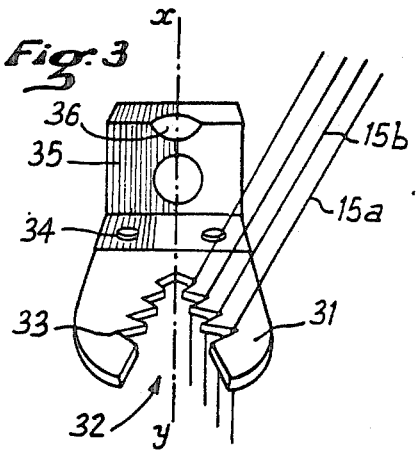
FIG. 3 is a view, in perspective, of an embodiment of the fiber guide of this invention.

FIG. 3 shows an embodiment of fiber guide 23. The guide is made from a plane plate 31 into which is cut opening 32 with an interior guide zone in the shape of a V. The opening is symmetrical about the median plane passing through axis x-y. This interior zone has on each side a series of V-shaped notches 33. The notches 33 are distributed symmetrically on both sides of the median plane passing through axis x-y. The ends of the notches are inclined in relation to the vertical as described above.

Part 31 is fastened by means, such as rivets 34, to a connecting piece 35. Piece 35, bent twice at right angles, includes perforations 36 to decrease its weight. Piece 35 is connected to the mechanism of crisscrossing device 26.

Other embodiments of the fiber guide of this invention can be used. The guide may be a single piece, as in the preceding examples, or have several stationary or mobile parts by which the configuration of the interior guide zone may be modified. Fiber guides of this invention are provided with notches on at least one side of the interior zone. The ends of the notches on the same side are located at different distances from the median plane passing through axis x-y.

In the fiber guide of this invention, each fiber 15 is placed at the end of one notch and positively guided during the entire winding operation. Fibers 15 are kept in the notches by reason of their passage through combs 16 which are outside a zone defined by two planes passing through the ends of travel of fiber guide 23 and perpendicular to the axis of rotation of spindle $B_1$.

The stops 41 attached to crisscrossing device 26 are adjusted so that end fibers 15*a*, 15*b* and their symmetrical counterparts in turn touch each stop.

Because the arrangement of the notches in fiber guide 23 and their relationship to combs 16 and the adjustable stops, the various fibers 15 are laid separately on package 28 during the entire winding operation, including the winding of the ends of the package.

A device of the present invention may use a winding machine with only a single spindle. It is more advantageous to use a drum winding machine equipped with at least two spindles $B_1$ and $B_2$ and means to automatically transfer the fiber from spindle $B_1$ to spindle $B_2$.

Figure 4:
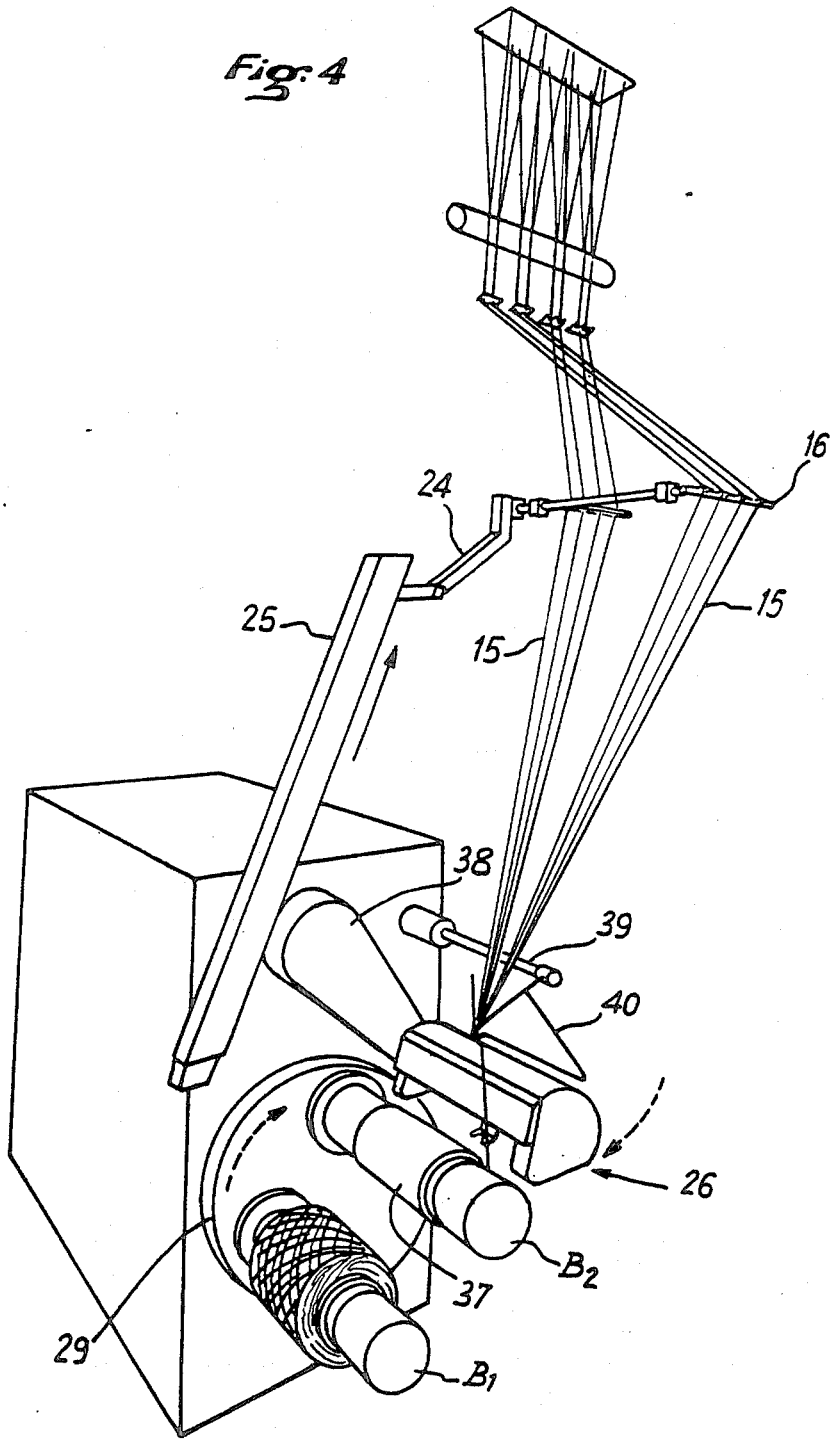
FIG. 4 is a view, in perspective, of the installation shown in FIG. 1 during one of the phases of the operation for transferring fibers from one rotating spindle to another rotating spindle.

This operation is shown by FIGS. 1 and 4.

When package 28 has reached a given weight at the end of a preset winding time, spindle $B_2$, equipped with a support or collar 37, is rotated and combs 16 are transferred to a higher position by the jack 25. Simultaneously, arm 38 which supports crisscrossing device 26 pivots, moving the latter away from spindle $B_1$. Telescoping arm 39, which has on its end a device 40 to gather fibers 15, joins the fibers and moves them to the end of spindle $B_1$ on which they have been wound.

Figure 5:
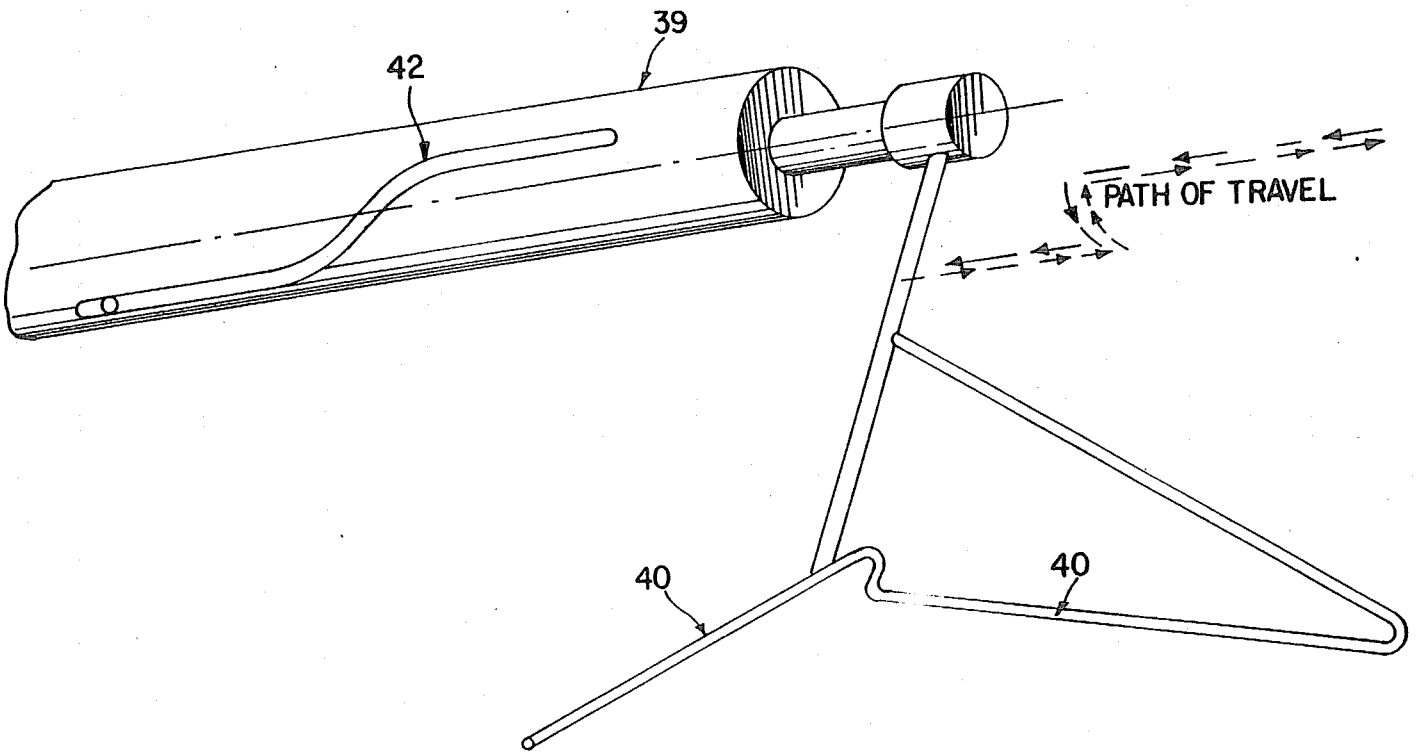
FIG. 5 is a detailed view of a fiber gathering device for use with this invention.

FIG. 5 is a detail drawing of the device 40. The device 40 removes fibers 15 from fiber guide 23 prior to positioning those fibers at the end of spindle $B_1$. After it has removed the fibers from guide 23, device 40 moves the fibers to the end of spindle $B_1$ and holds them in that position while spindle $B_1$ is replaced by spindle $B_2$ as described below. After the substitution of spindle $B_2$ for spindle $B_1$, device 40 returns the fibers to fiber guide 23.

The movement of the fibers 15 described above is achieved through the double movement, rotation and translation, of arm 39. Device 40 is rigidly attached to arm 39; its movement is guided by a cam 42 attached to the end of arm 39 inside winder device 17. Arm 39 is initially moved outward from winder device 17. During the translation of arm 39, cam 42 rotates the arm. This rotation of arm 39 positions device 40 to remove fibers 15 from fiber guide 23. Subsequently, the further translation of device 40 positions the fibers at the end of spindle of $B_1$.

Arm 39 remains extended, maintaining the fibers in a fixed position, as spindle $B_2$ is transferred into the position of spindle $B_1$. Arm 39 is then retracted toward winder 17 by the reciprocal double movement of arm 39. As the cam 42 rotates arm 39 during the return movement, the crisscrossing device 26 approaches spindle $B_2$. When arm 39 rotates, fiber guide 23 is driven back and forth to receive fibers 15. The rounded outside edges of the guide shown in FIG. 3 facilitate the introduction of the fibers 15 into the guide. The fibers are thus lodged in the bottom of the guide 23. When comb 16 is returned to its lower position by jack 25, each fiber is lodged in its notch 33.

Drum 29 pivots, placing spindle $B_2$ in working position and spindle $B_1$ in rest position. Fibers 15, still separated by arm 39 and device 40, are now wound on the end of spindle $B_2$. Transfer of the yarns from spindle $B_1$ to spindle $B_2$ can be achieved by various means not shown, in particular, such as described in French Pat. No. 2,425,399.

Arm 39 is moved back to its initial position and, simultaneously, crisscrossing device 26 is brought close to rotating spindle $B_2$. The fibers are automatically introduced into fiber guide 23. Combs 16 are brought to their low position by jack 25. Each fiber 15 is placed into one of notches 33 of fiber guide 23.

The device and process of the present invention produce packages of weights of up to thirty kilograms and with a fiber separation rate almost equal to 100%.

The edges of the packages are straight and extraction of the fibers is achieved without difficulties.

This invention relates to winding of glass fibers, but it is obvious that the invention applies to all continuous fibers obtained from a thermoplastic material, when at least two fibers must be kept separated during their winding on the same support.

We claim:

1. Apparatus for forming and winding on the same support several continuous fibers of thermoplastic material comprising:

a spinneret receiving said thermoplastic material and keeping said thermoplastic material in a molten state;

a rotating spindle carrying said support and mechanically drawing strands of said material from orifices of said spinneret in the form of elementary filaments;

a gathering and guide device to group said filaments into at least two separate fibers and to guide said fibers to said spindle;

a crisscrossing device near the spindle including a fiber guide driven back and forth by said crisscrossing device along a line of travel in front of said spindle, said fiber guide positively guiding said fibers and moving them back-and-forth to distribute said fibers on said support, said fiber guide having an opening in front of said spindle communicating with an interior guide zone of said fiber guide, at least two notches in said fiber guide communicating with and opening into said interior zone; and a stop positioned near each end of travel of said fiber guide for engaging at least the outside one of said fibers when said fiber guide reaches its end of travel.

2. Apparatus as claimed in claim 1 wherein the notches of the fiber guide are uniformly distributed on both sides of a plane passing through the center of the fiber guide and perpendicular to the axis of rotation of the spindle.

3. Apparatus as claimed in claim 2 wherein at least two notches are located on the same side of a plane passing through the fiber guide and perpendicular to the axis of rotation of the spindle and the distance from the end of a first said notch to said plane is different from the distance from the end of a second said notch to said plane.

4. Apparatus as claimed in claim 2 wherein the ends of the notches are located in several vertical planes parallel to the axis of rotation of the spindle.

5. Apparatus as claimed in claim 4 wherein the notches are staggered in two groups on each side of a plane passing through the center of the fiber guide and perpendicular to the axis of rotation of the spindle and are positioned so that the vertical planes passing through the ends of the last notches of each group form an angle between 5° and 90°.

6. Apparatus as claimed in claim 1 wherein the end of the notches is inclined in relation to the vertical.

7. Apparatus as claimed in claim 1 wherein the gathering and guide device for grouping the separate filaments into said fibers and directing said fibers to the spindle through the fiber guide on the crisscrossing device includes guiding slots, said guiding slots being placed outside a zone defined by the two planes perpendicular to the back-and-forth movement of said fiber guide and passing through the ends of travel of said fiber guide.

8. Apparatus as claimed in claim 7 wherein the guiding slots for guiding separate fibers to the fiber guide on the crisscrossing device is fastened by a fastening means to a rod positioned parallel to the axis of rotation of the spindle, said fastening means being adjustable to change the distance separating said guiding slots from the zone defined by the two planes perpendicular to the back-and-forth movement of said fiber guide and passing through the ends of travel of said fiber guide.

9. Apparatus as claimed in claim 8 wherein the rod holding the guiding slots is fastened by an arm to a jack which moves the guiding slots between a high position and a low position.

10. A process for producing and winding of several continuous fibers of thermoplastic material on the same support positioned on a rotating spindle, consisting of the steps of:

drawing mechanically material coming from the orifices of a spinneret in the form of elementary filaments under the action of the rotation of said spindle;

separating the filaments into at least two strands;

gathering the filaments of each strand into fibers;

maintaining the separation of said fibers by at least an upper comb and at least a lower comb;

further maintaining the separation of said fibers by locating said lower comb outside the zone between two planes passing through the ends of travel of a fiber guide on a crisscrossing machine and perpendicular to the back-and-forth movement of said fiber guide; and distributing said fibers on a support by use of said fiber guide driven in a back-and-forth movement parallel to the axis of rotation of said spindle.

11. The process as claimed in claim 10, which includes a further process for transferring fibers from one spindle onto another spindle, consisting of the steps of:

moving the lower comb away from a first spindle to a higher position close to the higher comb;

ejecting said fibers onto the end of said first spindle;

bringing a second spindle into the position of said first spindle;

transferring said fibers onto the end of said second spindle;

continuing the winding said fibers on a support placed on said second spindle; and bringing said lower comb back to its initial position as soon as the winding onto said support begins.

* * * * *